United States Patent [19]

Gibson

[11] 4,427,731

[45] Jan. 24, 1984

[54] DECORATIVE WALLCOVERING IN ROLL FORM

[75] Inventor: Frank Gibson, Darwen, England

[73] Assignee: Reed International P.L.C., London, England

[21] Appl. No.: 438,289

[22] Filed: Nov. 1, 1982

[30] Foreign Application Priority Data

Nov. 6, 1981 [GB] United Kingdom ..... 8133620
Mar. 23, 1982 [GB] United Kingdom ..... 8208461

[51] Int. Cl.[3] ..... B32B 3/00

[52] U.S. Cl. ..... 428/159; 428/213; 428/215; 428/306.6; 428/314.4; 428/316.6; 428/319.7; 428/904.4; 428/906

[58] Field of Search ..... 428/159, 213, 215, 220, 428/304.4, 306.6, 314.4, 316.6, 318.6, 319.7, 904.4, 906

[56] References Cited

U.S. PATENT DOCUMENTS 3,527,654 9/1970 Jones et al. ..... 428/159
3,620,890 11/1971 Kemmler ..... 428/304.4
4,022,943 5/1977 Erb et al. ..... 428/319.7

FOREIGN PATENT DOCUMENTS 7708684 2/1978 Netherlands ..... 428/318.6

*Primary Examiner*—William J. Van Balen
*Attorney, Agent, or Firm*—William R. Hinds

[57] ABSTRACT

A decorative wallcovering in roll form of the kind that is applied to the wall with adhesive, has a strength giving substrate ply (10), a mechanically foamed ply (11) having open and closed pores (13) with a decorative effect (12) on its exposed surface. A diffusion porous toughened surface (14) and print hold-out coat (15) is preferably provided before a printed decorative effect is applied. The print (12) may be hostile to the foam so long as the print application and drying is performed quickly. Texture effect can be achieved by selecting a substrate which has a degree of preferential absorption of one of the constituents of the foam in selected regions.

11 Claims, 3 Drawing Figures

DECORATIVE WALLCOVERING IN ROLL FORM

This invention relates to decorative wallcoverings in roll form of the kind that is applied to the wall with adhesive.

BACKGROUND OF THE INVENTION

Whilst wallcoverings in roll form of the kind above stated have been proposed in a large number of varieties, the present day market is mainly satisfied by five varieties, namely, printed papers, heavily embossed papers, vinyl plastisol coated papers, chemically foamed plastisols on a substrate, and paste-the-wall strippables which are formed from extruded polyethylene foams without a substrate.

The present invention is to be considered as an advantageous substitute for the last mentioned variety, which has a pleasant soft feel and good bulk. However, this variety is seen to have some disadvantages. There is a certain lack of robustness; an undesirable high stretchability which can give rise to pattern matching problems; printing, embossing and texturising limitations; slow drying after pasting and the need for high technological experience to make and handle extruded foams. In fact, the manufacture of extruded foams cannot be regarded within the day-to-day experience of paper convertors and hence an unwanted dependence has to be placed on external manufacturers.

It is with the above points in mind that the present invention has its creation and is seen to offer scope for reduction or elimination of the undesirable aspects of these points, whilst offering potential for lower weight wallcovering without loss of feel and bulk.

FEATURES AND ASPECTS OF THE INVENTION

The present invention employs a substrate ply which carries a mechanically foamed ply.

Laminates which include a mechanically foamed latex or vinyl plastisol ply are well known and in this respect reference is made to the foam-backed carpet industry. In general, the foam used as carpet backing tends to be of low density, is thick, is weak, has a low resistance to wear and is absorbent. Such foam lacks all qualities which could commend its use as a decorative ply in a wallcovering.

Mechanically foamed latices have been proposed (GB-PS No. 1, 371, 124) for application to the wall side of loose stranded fabric wallcovering. The foams are allowed to seep through the fabric. This would be intolerable for pastable wall coverings. Mechanically foamed latices have also been used as reverse-side fabric linings and drapes (GB-PS No. 1, 273, 468). They are frequently crushed after application to the base fabric. Undercoated thick (e.g. 4 mm) foam latices have been proposed in the context of heat-insulating wall-coverings.

The term "latex" is regarded as covering a stable dispersion of a polymeric substance in an essentially aqueous medium. Latices can be natural (as arise from plants and trees) or synthetic (as typified by styrene-butadiene rubbers, abbreviated as SBR). It is well known for latices to carry additive, or compounding ingredients such as vulcanising agents, accelerators, antioxidants, fillers and pigments, surface active agents, viscosity modifiers, waxes, resins, etc. according to the duty to be performed.

The compounding ingredients may be chosen so that the latex gives a gel or non-gel system, the former offering attractive embossing opportunities.

DESCRIPTION OF THE DRAWINGS

Forms of wallcovering according to the present invention will now be described, reference also being made to the accompanying drawing in which.

DESCRIPTION OF THE PREFERRED EMBODIMENTS

Figure 1:
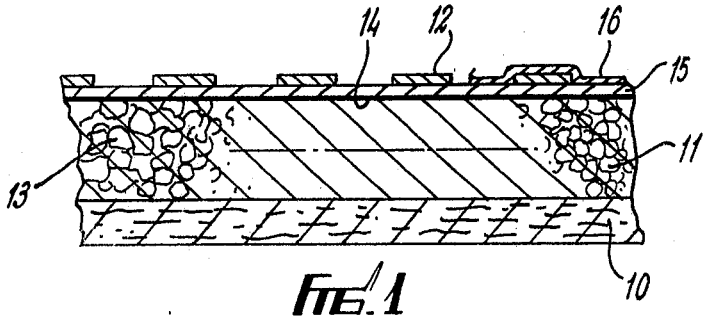
FIG. 1 is an enlarged cross-sectional view of a fragment of the wallcovering.

FIG. 1 shows a dimensionally stable wet laid non-woven strength-giving substrate ply 10 and an aqueous based mechanically foamed latex ply 11 presenting a decorative surface as represented by print 12. The dimensional stability of the substrate ply 10 is such as to avoid problems of pattern mismatch and blistering on hanging when "paste-the-wall" procedures are used. The voids, both open and closed, in the latex ply are indicated by numeral 13. Enough open cells are provided to allow the ply 11 to "breath" so that after pasting to a wall the drying time is not unduly delayed. Typically, the laminate shown is 0.4 mm thick but can readily be within the range of 0.3 mm to 1.0 mm in thickness with the foamed ply being at least twice as thick as the substrate ply. No particular advantages arise from making the foamed ply too thick and, in fact, problems may well arise with printing and with wear as the relatively thin foam has less tendency to damage than, say, the thicker foams encountered in other fields. Cost is also related to foam thickness. Foam voids can typically occupy about 80% of the foam volume. The foam ply has a toughened surface 14 and a very thin (less than 1/10th of the foam thickness) print hold out coat 15 offering diffusion (water vapour) porosity.

This closes up most of the surface open cells. A wear coat 16 may be applied to the printed product but this is not essential.

Figure 2:
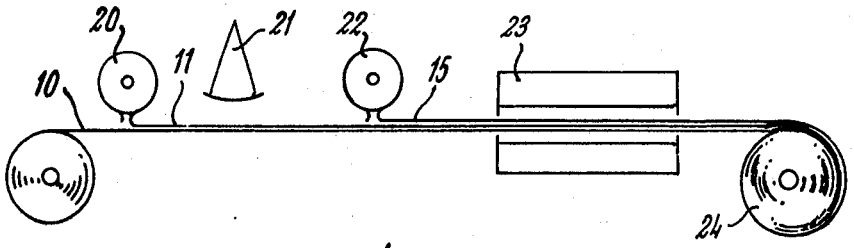
FIG. 2 is a diagram of manufacturing plant for making the wallcovering in FIG. 1.

The wallcovering above described is made (FIG. 2) by forming a fine stable polymer latex, such as SBR foam (mean cell size about 0.06 mm, density 200 g/l) in an agitator and aerator foam machine 20. The machine is operated at optimum shear so that the required fineness is achieved. The additives to the foam are selected so that the fineness of the foam is sustained. For example, solid additives such as pigments and fillers are prepared to a high degree of fineness. With the use of fine solids, and hence large surface areas, wetting agents are provided on a generous level.

The foam made as described above is spread on the substrate ply moving at about 35 meters per minute. The substrate ply and foam then pass under an infra-red heater 21 to toughen the surface of the foam and from this point to a coat applicator 22 where the diffusion porous print hold out coat 15 is applied, and thence to a drying and curing oven 23 (160° C.) to set the foam. The applicator 22 could follow the oven 23 with added drying facilities. The coat 15 could be derived from a spreadable unstable mechanical foam which collapses to give the required coat.

The cured laminate web thus obtained is reeled and taken to a printing station comprising gravure or other printing rollers and, where a wear coat 16 is required, a lacquer coat applicator.

The print hold out coat 15 can be made with emulsions such as those based on vinyl acetate polymers, vinyl-acrylic copolymers, styrene-acrylic copolymers and vinyl acetate-ethylene copolymers of the type Vinyl Products Vinamul 3452. A solvent lacquer could be used for coat 15 if it is applied at the printing station.

A typical substrate 10 is a cellulosic non-woven, Dexter X 4819 34 gsm having 15% polyester content. This is coated with the foam composition ILC LC 2850 at 76 gsm and then given a 20 gsm print hold out coat based on Vinamul 3452 emulsion. An alternative hold out coat 15 is an acrylic-based lacquer such as M 15947 by Irlam Inks Limited.

The decorative printing by the gravure process uses solvent based vinyl chloride-vinyl acetate copolymer inks having MEK/Toluene mixture as the solvent system. Both these solvents are hostile to the foam but are acceptable nevertheless with operating speeds of 100 m/min. giving a residence in the drying-after-print zone of 1.5 seconds. A wallcovering as described above with reference to the drawings may have a weight of 130 gsm.

The substrate ply materials chosen should be tested for relative absorbency of the foam constituents as selective absorption of one constituent may affect the nature of the foam obtained. In general, absorbency should be the same for both constituents although slight differences could probably be tolerated or even selected in selected areas if textured differences were desired in the foam.

Substrates in the classes of wet-laid non-woven products and spun-bonded products can generally be used without pre-treatment.

The invention provides opportunities to print with either solvent or water based inks. As mentioned above, if printing followed by fast drying takes place it is possible to use solvent based inks which, on the face of it, appear hostile to the foam. Thus, solvent based inks containing P.V.C. or P.V. Ac. copolymers; or acrylics, as typically used for gravure printing of vinyl wallcoverings; or polyamides, typically used for printing foamed polyethylene wallcoverings or nitrocellulose, typically used in flexographic printing; are satisfactory.

Water based inks using acrylic resins, or water dispersed alkyds or P.V.C. based inks are also satisfactory.

The invention also has merit that the solvent levels can be kept very low in the overall process especially if water based inks are also used.

If no print hold-out coat 15 is used, then dye receptive resins can be incorporated in the latices so that the wallcovering can accept transfer printing from a bank of transfers common with the printing of textiles (such as curtains or bed coverings) which have to co-ordinate with the wallcovering. In this way exact colour tones can exist througout a co-ordinate system. The foam may then include wetting agents which are surface exposed so that washability with water is possible. Wallcoverings according to the invention are intended for use on a "paste-the-wall" basis and have the strength to allow for "whole-piece" stripping. Such wallcovering has the quality of low stretch when being hung and this aids pattern matching.

The foam ply could be applied over the whole substrate or over selected areas by a printing system. The foam ply could be self-coloured and the colouration could be related to the general surface decorative colouring with the object of arranging that cut or trimmed edges do not stand out in contrast to the decoration.

A self-coloured foam ply could also be used without further printing, the self colouration providing the decorative effect. This has advantages over pad-coating to give a single colour effect as edge tone problems are avoided.

The surface of the product can be textured by hot roll embossing.

In an alternative embossing process a gel system is used. This is now described with reference to FIG. 3.

A substrate ply 10 passes below an agitator and aerator foam machine 30 where a foam ply 11 treated to gel is applied. (Techniques of gelling latices are described in "Polymer Latices and their Application" edited by K. O. Calvert: Applied Science Publishers (1982): See pages 82 et seq). The laminate 10/11 is then passed below an infra-red heater 31 at which the foam is gelled and a toughened coat is generated. The laminate then proceeds to a cold roll embossing system 32 and a drying and curing oven 33, set at 160° C. A deep, sharp emboss can be achieved.

A wallcovering as described above with reference to FIG. 3 can, for example, be made by coating ILC foam composition LC 817 onto 50 gsm non-woven Storalene 555-50. The thickness of the wallcovering was 0.8 mm and the total weight was 250 gsm. This weight is to be compared with the weight of comparable known chemically foamed plastisols of 350 gsm for which the wallcovering of FIG. 3 can be satisfactory substitute.

After the oven 33, the product could be rewound for subsequent processing, such as printing, or it could be direct wound into pieces of finished wallcovering.

The emboss system is preferably of "flat-back" form so that the product remains flat on the wall side. The gelled, but uncured foam, is capable of accepting and retaining the emboss without any adhesion to the embossing roll.

Printing could be effected at the same time as embossing by fitting an inking system on to the embossing system. Typically the embossing roller could give valley inking with the embossing process. As the roller is cooled the use of water-based ink is possible.

Printing can also be provided at other points in the line. For example, the tips of the emboss could be printed. This, taken with valley inking, could generate a three colour textured product; the first colour being that derived from a pigmented latex, the second colour being the valley print, and the third colour being the tip of the emboss. Printing could be done with a foamable ink to give a further texture. A clear wear layer could be added.

Figure 3:
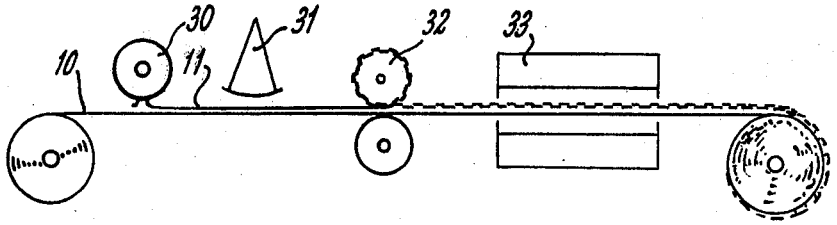
FIG. 3 is a diagram of a manufacturing plant using a gel system.

By applying an emboss to gelled foam prior to curing, a substantially permanent emboss is obtained. To emboss after curing introduces the risk that the emboss could be lost if, in use, the product is subject to heat, such as may arise over radiators or on chimney breasts.

Where a wallcovering as described with reference to FIG. 3 is made for all-over decoration by the purchaser it is improbable that a print hold-out coat would be required.

I claim:

1. A decorative wallcovering in roll form for application to the wall with an adhesive, said wallcovering having a substrate ply which carries a mechanically foamed ply, characterized in that the foamed ply is one derived from an aqueous latex, has both open and closed pores, has a toughened and porous surface and has outwardly facing decoration, and in that the substrate ply is thin, strength-giving, dimensionally stable, and primarily nonselectively absorbent to the constituents of the foam to provide a low stretch paste-the-wall strippable wallcovering.

2. A wallcovering as claimed in claim 1 in which the toughened and porous surface has a print hold-out coat, the thickness of the wallcovering is in the range of 0.3 to 1.0 mm, the foamed ply is at least twice the thickness of the substrate ply, and the hold-out coat is less than one-tenth the thickness of the foamed ply.

3. A wallcovering as claimed in claim 1 in which the decoration comprises inks having solvents hostile to the foamed ply but rendered non-hostile by fast drying.

4. In combination with a wall, a decorative wallcovering having a substrate ply which carries a mechanically foamed ply, characterized in that the substrate ply is pasted to the wall, thin, strength-giving so as to be strippable as a piece, dimensionally stable, and primarily non-selectively absorbent to the constituents of the foam, and in that the foamable ply is one derived from an aqueous latex, has both open and closed pores, has a toughened and porous surface, and has outwardly facing decorative effect.

5. A combination as claimed in claim 4 in which the toughened and porous surface has a print hold-out coat, the thickness of the wallcovering is in the range of 0.3 to 1.0 mm, the foamed ply is at least twice the thickness of the substrate ply, and the hold-out coat is less than one-tenth the thickness of the foamed ply.

6. A combination as claimed in claim 4 in which the decoration comprises inks having solvents hostile to the foamed ply but rendered non-hostile by fast drying.

7. A wallcovering as claimed in claim 1 in which the decorative effect is produced, at least in part, by having a substrate ply of selected preferential absorption in selected regions of one of the constituents of the foamed ply to create textured differences.

8. A wallcovering as claimed in claim 1 in which dye receptive resins are exposed prior to the application of the decorative effect.

9. A wallcovering as claimed in claim 1 having an emboss applied to the foam in the gelled state.

10. A wallcovering as claimed in claim 9 including tip and valley printing of a pigmented foam to generate multi-colour relief product.

11. A wallcovering as claimed in claim 1 in which the substrate ply is a wet-laid non-woven or spun-bonded product devoid of pretreatment.

* * * * *